US005863238A

United States Patent [19]

Felstehausen

[11] Patent Number: 5,863,238

[45] Date of Patent: Jan. 26, 1999

[54] COB CUTTER BLADE HONING DEVICE

[75] Inventor: Eugene Felstehausen, Hoopeston, Ill.

[73] Assignee: Felste Co., Inc., Hoopeston, Ill.

[21] Appl. No.: 704,940

[22] Filed: Aug. 30, 1996

[51] Int. Cl.[6] ..... B24B 3/40

[52] U.S. Cl. ..... 451/65; 451/296

[58] Field of Search ..... 451/48, 65, 57, 451/296, 305, 374

[56] References Cited

U.S. PATENT DOCUMENTS

| | | | |
|---|---|---|---|
| 2,410,348 | 10/1946 | Johanson et al. | 451/48 |
| 3,605,343 | 9/1971 | Knecht | 451/65 |
| 5,609,512 | 3/1997 | Holmes et al. | 451/48 |

*Primary Examiner*—Robert A. Rose
*Attorney, Agent, or Firm*—Knechtel, Demeur & Samlan

[57] ABSTRACT

A cob cutter blade honing device which hones the convex and concave sides of a cob cutter blade in a single process is provided. A cob cutter blade to be sharpened is placed into a mounting bracket found at the top of a vertical spindle. Manipulation of an operator control means causes a vertical shaft to engage the hole of the cob cutter blade, aligning it against a locator surface. A locking mechanism then locks the blade into position. Further manipulation of the operator control means rotates the spindle from the alignment and locking position into the honing position. Once in this position, further manipulation of the operator control means causes a movement of the spindle about its vertical axis. As the spindle rotates, a grinding belt engages the convex surface of the cob cutter blade thereby sharpening it and cutting an appropriate toe-to-heel angle. Further rotation of the spindle moves the blade into position in front of a honing stone. The honing stone engages the concave side of the cob cutter blade's creating a beveled edge along the blade cutting tip.

30 Claims, 5 Drawing Sheets

COB CUTTER BLADE HONING DEVICE

TECHNICAL FIELD

This invention relates to a blade honing device and more particularly to a honing device for honing the blades of knives used in the shucking of corn kernels from corn cobs.

BACKGROUND OF INVENTION

In processing corn, it is necessary to shuck, or cut, the corn kernels from the cob. Over the years, several machines have been developed to effectuate this process. An example of such machine is seen in U.S. Pat. No. 5,041,057. These machines generally have six cutting surfaces. Each cutting surface, or cob cutter blade, consists of a counter-balanced knife having a U-shaped blade which is curved along its longitudinal axis to approximate the curvature of an average piece of corn. The curvature creates a convex and concave side of the blade. The cutting surface of the blade, found at its tip, has a heel and a toe, with the toe being greater in height than the heel, thereby creating an angled cutting surface. An example of a cob cutter blade is seen in U.S. Pat. No. 5,232,404.

In the processing of sweet corn for human consumption, the kernels are soft and can be easily crushed or partially cut if the blades are dull. During typical use, the blades become dull and must be resharpened every four to six hours. With proper care a blade may last up to three packing seasons. Without proper care, the blades can deteriorate quickly. Therefore, the proper sharpening of the blades is critical.

PRIOR ART

Until development of the present invention, the sharpening process has been time consuming, costly and inefficient. Typically, blades have been resharpened either by hand, with a grinding wheel or with a grinding wheel based device designed to sharpened cob cutter blades.

The prior art contains numerous sharpening and honing devices. Representative examples of these devices include U.S. Pat. No. 2,780,897 to Radse for a combined sharpening, sanding and honing machine. This device contains an abrasive belt for sanding and a separate honing stone for sharpening and honing. The operator manually places the blade against the abrasive belt and at appropriate times during the sharpening and honing cycle, removes the blade from the abrasive belt and manually applies it to the honing stone. The honing stone is fixed and the operator must manually move the blade over its surface.

U.S. Pat. No. 3,896,592 to Wintz discloses and claims an apparatus for sharpening rotary lawn mower blades. This device also utilizes an abrasive belt for sharpening. It does not contain a honing stone.

U.S. Pat. No. 4,461,121 to Motzer discloses and claims a program controlled grinding machine which is particularly suited to sharpening rotatable cutting tools such as drill bits. This device utilizes rotating grinding wheels to sharpen the tool.

Yet another example is found in U.S. Pat. No. 5,199,220 to Steiner which discloses and claims a combination belt and disc sander. This device is particularly suited to sharpening a work piece at a desired angle.

While all of the described prior art is well suited for a particular use, none of the prior art discloses nor is suitable for use in the sharpening of curved blades such as those found in cob cutter blades. The prior art is directed to the sharpening of flat or circular surfaces. Also, none of the prior art discloses as possible the simultaneous sharpening and honing of both the convex and concave sides of U-shaped blades in a single process.

An example of an unpatented cob cutter blade sharpening device is found in a knife sharpener manufactured by Computer Controlled Machines of Northfield, Minn. In this device, multiple blades are inserted into the sharpener and via an electronically controlled grinding wheel, the convex surface of the blades are sharpened. A shortcoming of this device is that only the convex surface of the blade is sharpened. No sharpening of the concave side of the knife is possible. This results in a blade which does not work to optimum efficiency, dulls more quickly, and must be replaced more often than one sharpened on both sides of the cutting surface. Another shortcoming of this device is that multiple blades are sharpened at the same time. This creates a situation in which, if one blade is smaller than the other blades or needs more sharpening work, the remaining blades are ground down further than need be, resulting in the decreased life of the cutting blades.

Thus, there is need for a honing device which hones both the convex and concave sides of the U-shaped blade in a single cycle without unnecessarily decreasing the blades' life.

OBJECTS OF THE INVENTION

An object of the present invention is to provide a cob cutter blade honer which sequentially sharpens both the concave and convex surface of the cob cutter blade in a single process. A related object is to provide a bevel on the cutting edge of the blade.

Another object of the present invention is to provide a cob cutter blade honer which precisely aligns and locks in the blade.

Another object of the present invention is to provide a cob cutter blade honer which utilizes both a grinding belt and an automated honing stone to hone cob cutting blades.

Still another object of the present invention is to provide a cob cutter blade honer which sharpens each cob cutting blade individually.

Yet another object of the present invention is to provide a cob cutter blade honer in which the honing cycle, pressure and angle of the sharpening devices can be adjusted to provide precise sharpening.

SUMMARY OF THE INVENTION

The above objects of the present invention are provided in a cob cutter blade honing device which through minimal manipulation by the operator, sequentially hones the convex and concave sides of a cob cutter blade in a single cycle. At the top of a vertical spindle, through which many of the features of the device operate, is found a mounting bracket for placement of the knife body. To the right of the knife body is found a locator surface around which the concave blade surface of the knife fits for appropriate alignment. Upon operator manipulation of an engagement lever, a vertical shaft engages a hole in the cob cutter blade, aligning it against the locator surface's radius surface. Through a delay mechanism, a locking mechanism locks the blade into position after being properly aligned.

Upon further operator manipulation of the engagement lever, the spindle rotates, thereby moving the blade from the alignment and locking position into the honing position. Once in this position, the operator again manipulates the engagement lever which in turn causes a sweeping movement of the spindle. As the spindle sweeps, a vertically disposed, off horizontal grinding belt engages the convex surface of the cob cutter blade thereby sharpening it and cutting the appropriate toe-to-heel angle. Once the blade has swept past the grinding belt, it moves into position in front of a honing stone. The honing stone is operated by a cam system which causes downwardly and inwardly movement against the concave side of the blade creating a beveled edge along the blade cutting tip. Once the vertical movement of the honing stone is completed, the cam system pulls the stone from the blade and raises it for the next sweeping pass of the spindle. The blade is then swept back across the grinding belt to the honing position.

The process is controlled by a cycle timer and is repeated until the blade is properly honed on both the concave and convex sides.

DESCRIPTION OF THE PREFERRED EMBODIMENT

Figure 1:
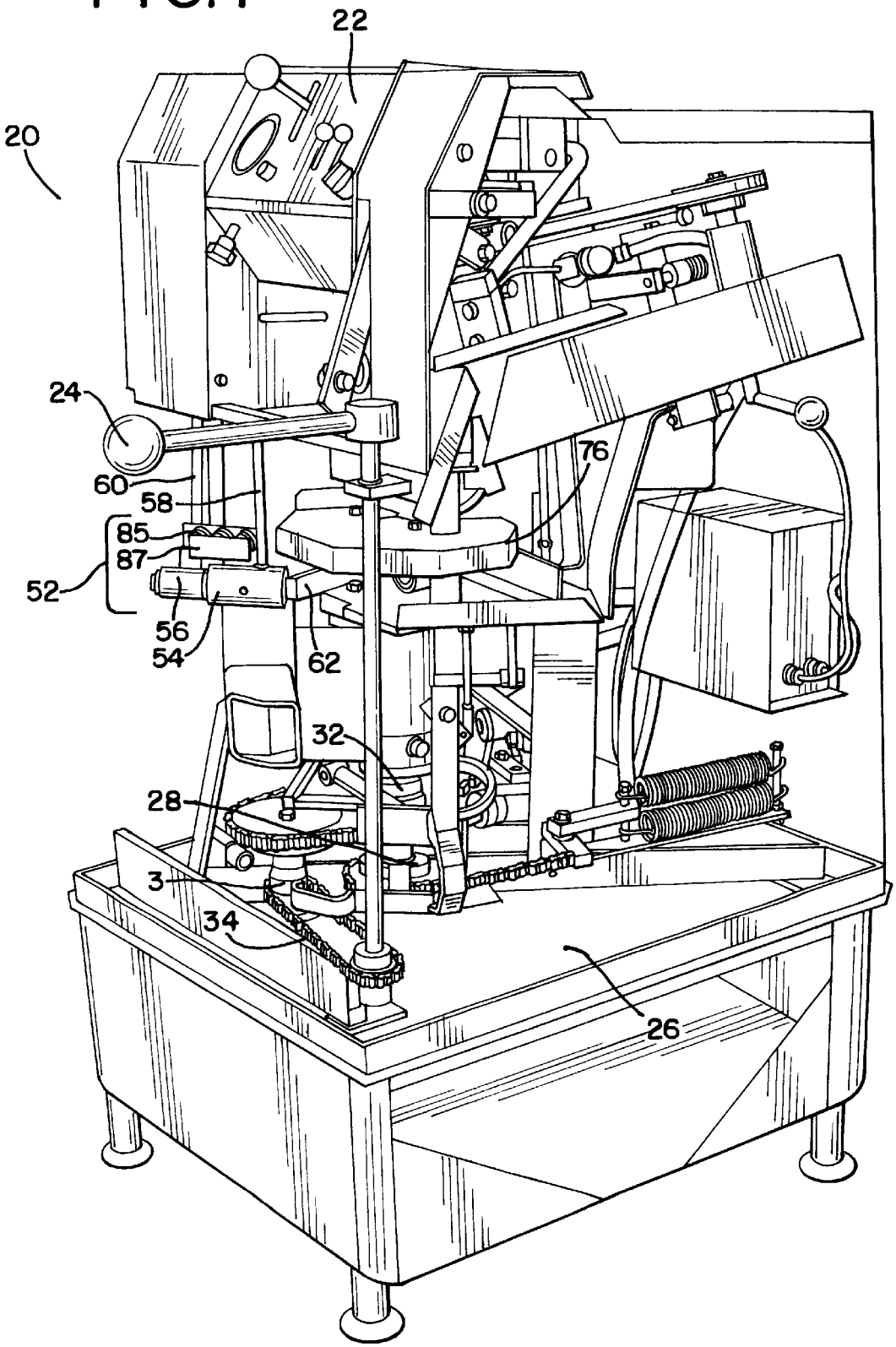
FIG. 1 is a front right oblique view of the cob cutter blade honing device.
Figure 2:
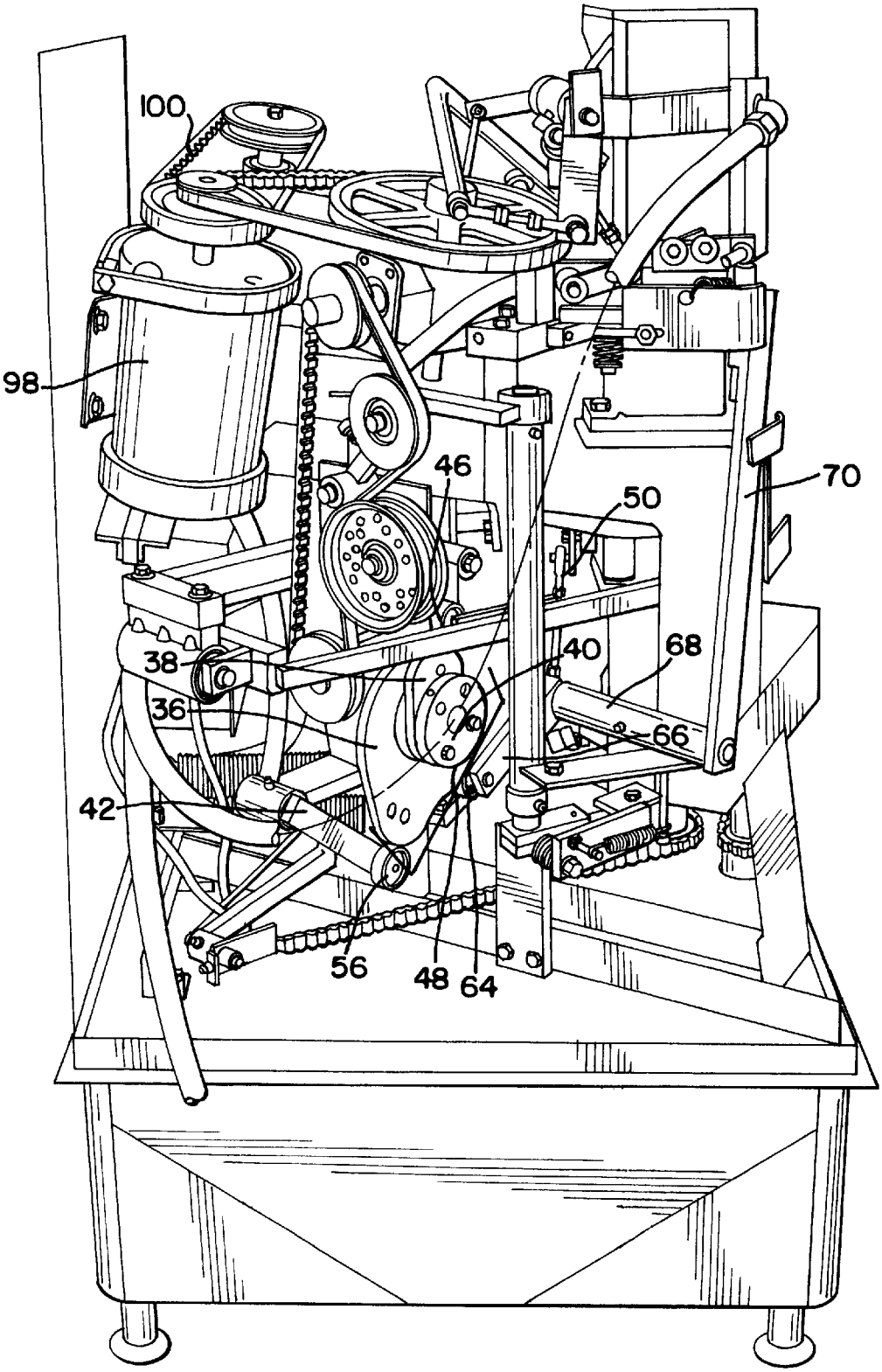
FIG. 2 is a rear view of the device.
Figure 3:
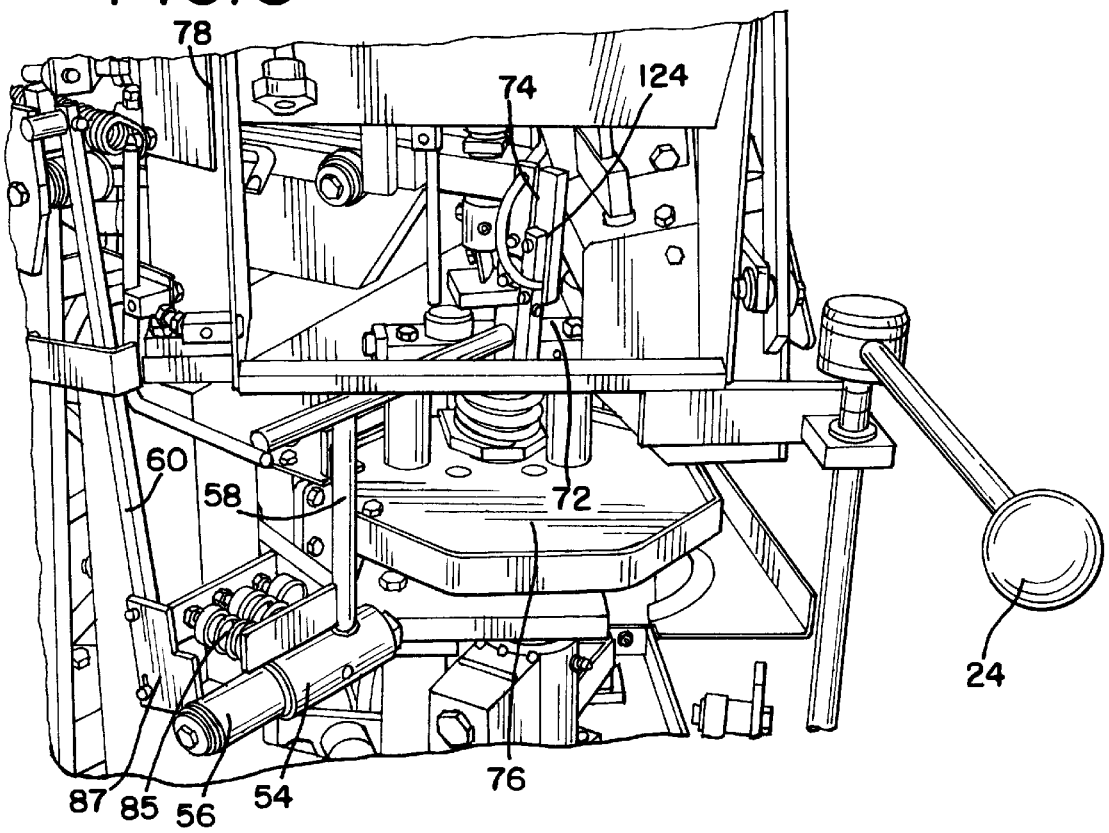
FIG. 3 is a front view of the device with portions removed to show the grinding belt and honing stone.

Referring to the drawings, a cob cutter honing device according to the present invention is illustrated in FIGS. 1 and 2. The device 20 is essentially rectangular in shape. FIG. 1 shows the front surface on which is located a control panel means 22 which contains mechanisms for controlling the cycle count of the honing process, and the pressure which is applied to a first honing means 72 (FIG. 3) and second honing means 74 (FIG. 3). Also seen in front of the device is engagement lever 24. Engagement lever 24 controls the movement of spindle 32 about a vertical axis. As discussed below, the engagement lever 24 is manipulated by the operator several times during a honing cycle to move the spindle into the appropriate operating position.

Spindle 32 is rotatably affixed to base plate 26 by mounting means 28 which allows the spindle to rotate about its vertical axis. Adjacent to mounting means 28 is located spindle gear 30 which, upon manipulation of engagement lever 24 operates chain 34 thereby rotating spindle 32. Vertically mounted adjacent the longitudinal axis of spindle 32 is cam system 48 (FIG. 2). Cam system 48 is compised of three cams: large cam 36, inner cam 38 and exterior cam 40.

Turning to FIG. 2, large cam 36 when activated via the engagement lever 24 applies pressure to spindle rotation rotor 56 which in turn causes downward movement of spindle rotating bar 42 causing spindle 32 to rotate 100°. Inner cam 38 applies pressure to second honing means vertical lift rotator 44 which causes second honing means vertical lift bar 46 to apply upward and downward movement to shaft 50 thereby raising and lowering second honing means 74.

Exterior cam 40 applies pressure to engagement cam rotor 64 which, in turn, causes downward movement of engagement cam transfer arm 66, thereby rotating transfer cam horizontal bar 68. This causes a backward and forward movement of engagement cam vertical arm 70. Engagement cam vertical arm 70 causes second horizontal arm 62 (FIG. 1) to move inward and outward. Returning to FIG. 1, it is seen that at the end of horizontal arm 62 is found tension cam system 52 which has an inner cam 54 and outer small cam 56. Mounted vertically to inner large cam 54 is rod 58 and mounted vertically to small outer cam is second rod 60. Horizontally mounted to the end of rod 58 and second rod 60 is a second horizontal arm (not shown) which connects directly to honing means 74 causing it to move in and out. Disposed between and connected to inner large cam 54 and outer small cam 56 is tension spring system 83 which has 3 springs 85 disposed between two plates 87. The springs create 5 to 10 pounds of pressure on rod 58. This pressure dissipates through the second horizontal arm 62 supplying 1 to 5 pounds of pressure to honing means 74 at the concave surface of blade 86. The amount of pressure honing means 74 exerts on blade 86 depends on the quality of honing means 74. The harder the honing stone used as honing means 74, the less pressure is dissipated resulting in increased pressure against blade 86.

Figure 6:
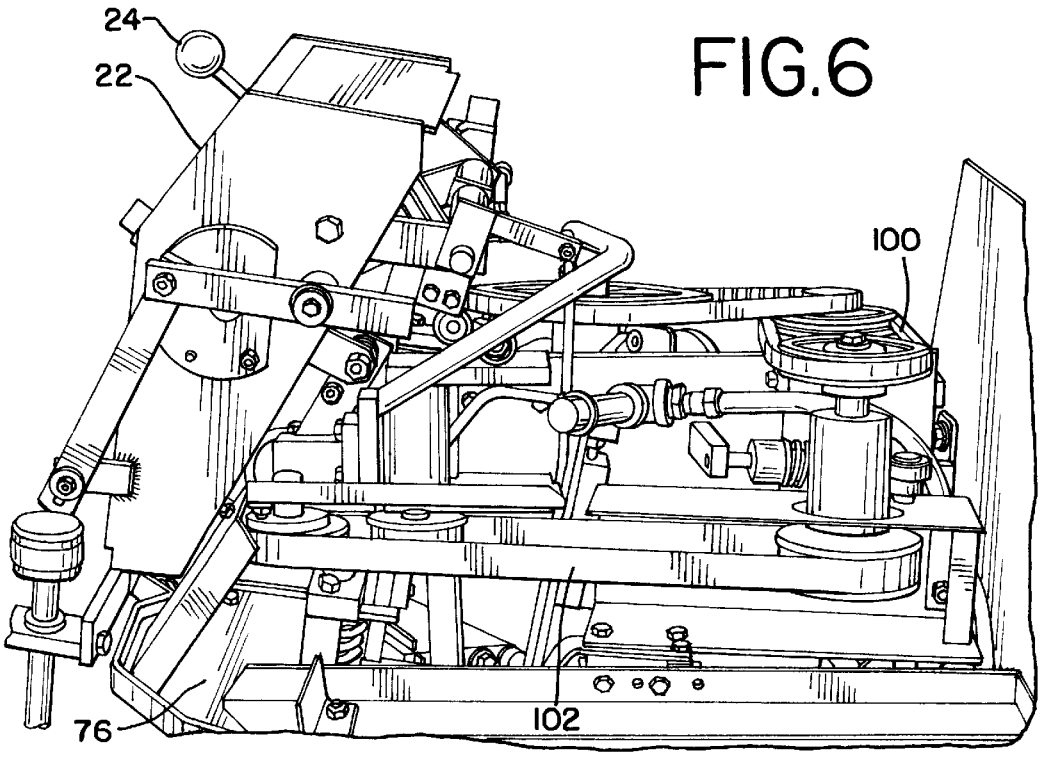
FIG. 6 is a side view of the grinding belt mechanism.
Figure 9:
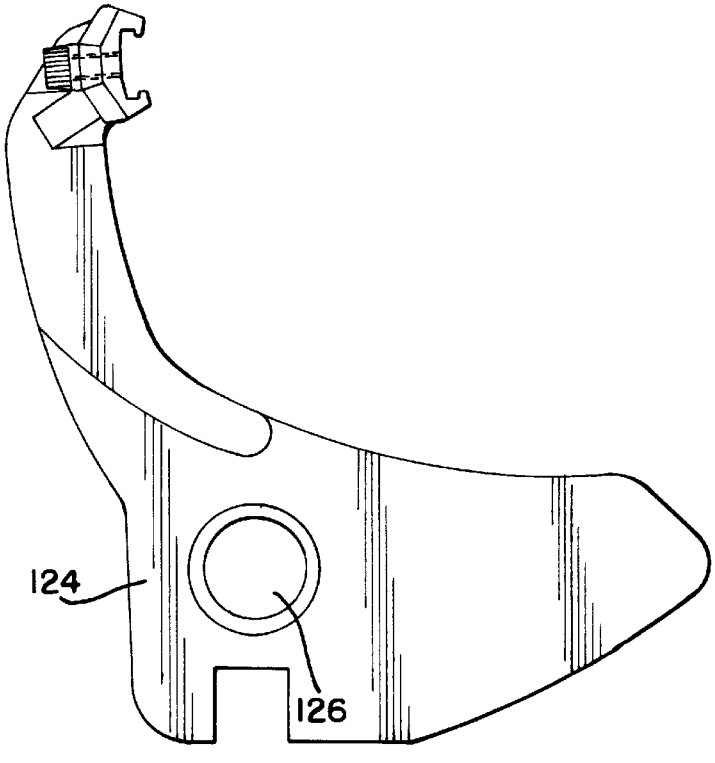
FIG. 9 is a top view of a cob cutter blade body.

Referring to FIG. 6, near the top of spindle 32 is found spindle plate 76 which has the primary function of preventing oil and shavings from dropping down into the working mechanism of the device. At the top of spindle 32 is found horizontal mounting bar 122. Horizontal mounting bar 122 has affixed to its upper surface cutter blade mounting bracket 80. This bracket has a fixed slot for accepting the flat body of a cob cutter blade 124 (FIG. 9).

Figure 4:
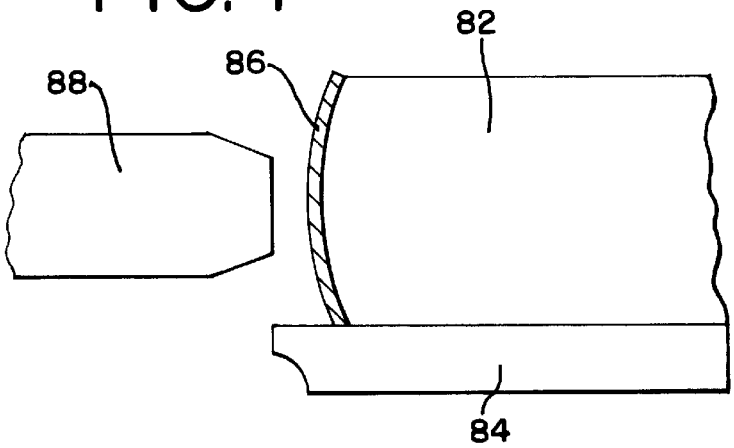
FIG. 4 is a cross-sectional top view of locating surface, cob cutter blade, and pressure applicator.

A cob cutter blade 86 has a hole in it 126 (FIG. 9) for attachment to the cob cutting device. This hole fits over the top of mounting bracket 80. The body of the cob cutter knife extends past mounting bracket 80 such that its vertical blade comes in contact with the radius surface 90 of locator surface 82. At the lower outer edge of locator surface 82 is found stop 84 which prevents the cob cutter blade surface from passing beyond locator surface 82. Directly in front of locator surface 82 is found pressure applicator 88. As described below and seen in FIG. 4, pressure applicator 88, when activated, applies pressure to blade 86 to firmly retain it against surface locator 82 which provides a means for aligning the blade prior to honing.

Turning to FIG. 6, located behind and adjacent to locator surface 82 is first honing means 72. First honing means 72 optimally consists of a flat surface continuous belt grinder. First honing means operates continuously during operation of the device 20 by means of an electric motor 98 (FIG. 1) and a belt drive 100 (FIG. 1).

Adjacent to first honing means 72 is second honing means 74. This is most clearly illustrated in FIG. 3. Second honing means 74 consists of a honing stone mounted to honing stone lift shaft 124. The free longitudinal edge of second honing means 74 is curved to a radius of approximately 0.79 inches. This curvature best approximates the circumferential curve of the average corn cob. Thus, as the second honing means 74 hones the concave surface of a cob cutter blade, it hones it to a shape approximating the circumference of a corn cob.

To initiate a honing cycle, a cob cutter blade 86 is inserted into cutter blade mounting bracket 80. The vertical blade portion of the cob cutter blade 86 is positioned in front of locator surface 82. Locator surface 82 has a radius surface 90 having a radius of 0.79 inches which matches the inner surface of the cob cutter blade. Upon a 90° manipulation of engagement lever 24, vertical shaft 78 lowers via a lever mechanism (not shown) into the hole 126 of the cob cutter blade. Vertical shaft 78 applies between 2 pounds and 4 pounds of horizontal pressure to the cob cutter blade, thereby aligning it against the stop 84 of locator surface 82. Vertical shaft 78 can move the cob cutter blade as much as ½ inch. Through a delay mechanism in the same lever device as the vertical shaft, pressure applicator 88 applies approximately 60 pounds of pressure on blade 86 against locating surface 82's radius surface 90. This action aligns the blade so that it will properly engage first honing means 72 and second honing means 74.

Figure 5:
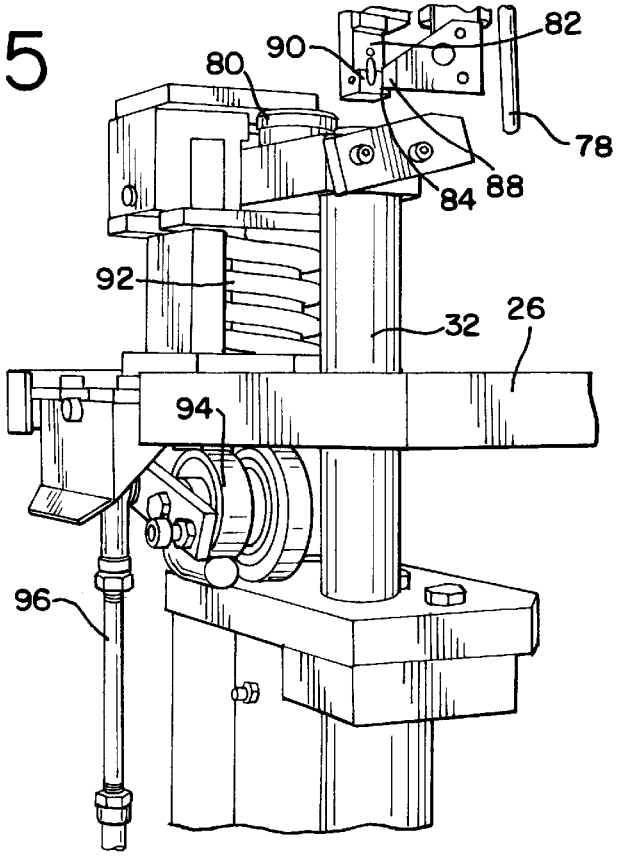
FIG. 5 is a side view of the blade mounting, aligning, and locking mechanism.

As seen in FIG. 5, manipulation of engagement lever 24 back to its original position causes lock rod 96 to move in a downwardly direction, thereby causing eccentric 94 to rotate. Rotation of eccentric 94 pulls clamping spring 92 in a downwardly position. Clamping spring 92 is locked into place by the rotating movement of eccentric 94. Clamping spring 92 requires approximately 400 pounds of downward pressure to move the mounting bracket 1/16 of an inch locking the cob cutter blade into position. If a particular blade does not readily fit against the locator surface or lock into place, it is discarded and replaced with a new cob cutter blade.

As the engagement lever 24 is brought back into the starting position, pressure applicator 88 moves away from the blade. Manipulation of engagement lever 24 to its starting position further rotates the spindle 32 approximately 60° to locating position 106. This places the blade into position for honing.

Figure 7:
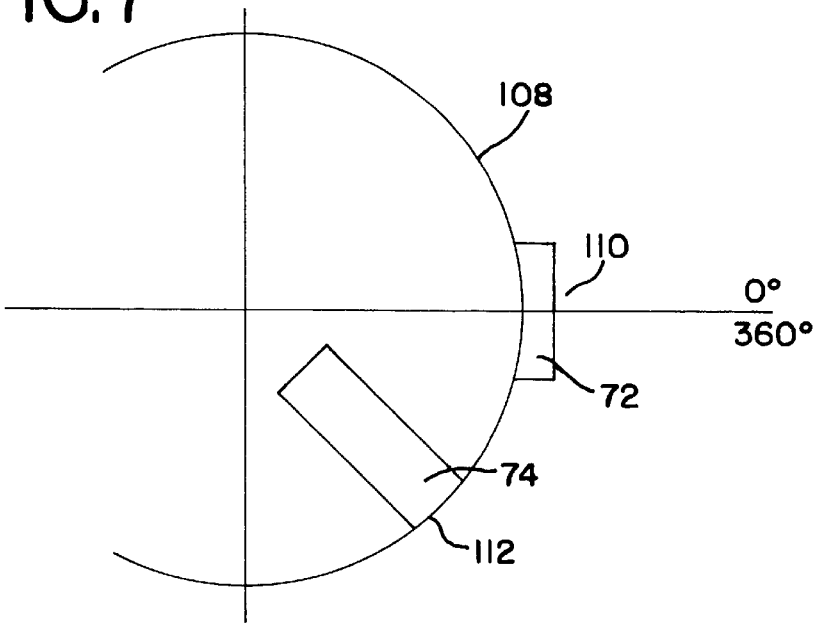
FIG. 7 is a top view rendering illustrating the blade movement during the sharpening cycle.

Further manipulation of engagement lever 24 to a 90° angle further rotates spindle 32 via the action of large cam 36. Large cam 36 moves the spindle through the honing process. As seen in FIG. 7, the spindle moves between 20° and 340°, the convex surface of blade 86 engages with first honing means 72 which is located at 0° 110. The substantially vertically disposed belt 102 (FIG. 6) of first honing means 72 is mounted slightly off the horizontal axis so that as the convex surface of blade 86 is sharpened, the appropriate toe-to-heel able is created.

As spindle 32 continues to rotate, second honing means 74 engages the concave surface of blade 86 as it moves from 330° to 280° at stone honing position 112. Inner cam 38 causes second honing means 74 to move in an downwardly direction as blade 86 moves from 330° to 280°. At the same time, exterior cam 40 causes second honing means 74 to move in an inwardly direction against the blade 86. The movement of the honing stone against the concave blade surface results in a beveled edge at the cutting tip. Prior to applicant's invention, this could not be achieved automatically.

As blade 86 approaches 280°, exterior cam 40 causes second honing means 74 to move in an outwardly direction away from blade 86. As the spindle returns to honing position 108, inner cam 38 causes second honing means 74 to move in a upwardly position, resetting it for subsequent honing cycle. The honing cycle is repeated several times until the blade is adequately sharpened.

Figure 8:
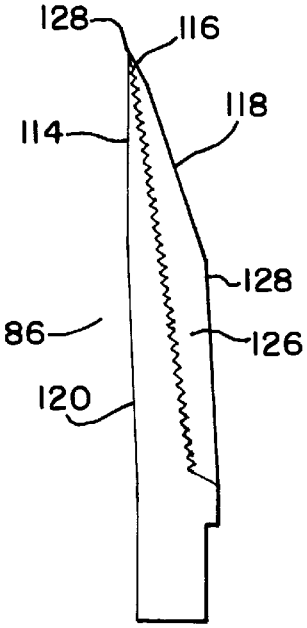
FIG. 8 is a cutaway side view of a sharpened blade.

Referring to FIG. 8, cob cutter blade 86 is shown after a sharpening cycle. Convex surface 120 is shown on its vertical axis and, by convention, is considered to be honed at a 90 off vertical angle. Concave surface 126 has edge 128. This edge also lies along the vertical axis. Cutting tip 128 has two angles as a result of the honing procedure. The first angle 118 is at 1°50'. The second angle 116 is the beveled edge created by the second honing means 74. The second angle 116 should be between 6° and 10° with an optimal angle of 8°. The beveled edge creates a sharpened cob cutter blade superior to that currently available with existing blade honing methods and apparatuses.

The above description of the preferred embodiment is for illustration purposes only. Those skilled in the arts will readily observe that additional advantages and uses for the device are possible. The specification should be read in its broadest sense and be applicable to the honing of all U-shaped blades and limited only by the appended claims.

I claim:

1. A blade honer for honing blades having a cutting tip, the cutting tip defining a first edge and a second edge, the distance between the first edge and second edge being curved to further define concave and convex blade surfaces, the honer comprising:

a rotatably mounted vertical spindle;

a mounting means affixed to one end of the spindle to accept the cob cutter blade;

alignment means to accurately position the blade on the spindle;

locking means to securely retain the blade;

a means to rotate the vertical spindle from an alignment and locking position to first and second honing positions;

a first honing means further comprising a continuous belt grinder for engaging the convex surface on the blade on the first honing position;

a second honing means engaging the concave surface on the blade at the second honing position;

means for adjusting the pressure of the first and second honing means against the whereby the concave and convex surfaces of the blade are honed without removing the blade from the locking means.

2. A cob cutter blade honer comprising:

a rotatably mounted vertical spindle for moving a cob cutter blade from an alignment and locking position into a honing position;

drive means for rotating the spindle;

mounting means for securing a cob cutter blade to the hone;

an alignment means for accurately positioning the cutter blade within the honer;

locking means for securing the cutter blade into position for honing;

a first honing means for honing a 9° off vertical edge on the convex surface of the cob cutter blade;

a second honing means for honing a beveled edge on the concave surface of the cob cutter blade;

means for adjusting the pressure of honing of the first means and second honing means;

a cam system vertically mounted adjacent to the spindle which enables movement of the second honing means in an upwardly and downwardly direction and also enables movement of the second honing means into and away from the vertical blade; and a cycle control apparatus.

3. The apparatus of claim 2 wherein the first honing means hones the convex surface of the knife blade substantially 9° off vertical angle.

4. The apparatus of claim 1 wherein the second honing means comprises a honing stone which moves up and down and into and out from the concave surface of the blade.

5. A honing device for knives having a flat horizontal body and "U" shaped vertically extending blades with convex and concave surfaces and a cutting tip at the end of the blade opposite from the flat horizontal body as commonly seen in cob cutter blades comprising:

a spindle rotatably mounted at one end to a base plate;

mounting means affixed to the free end of the spindle for securing a knife;

operator control means connected to the means to rotate the spindle for manipulation of the spindle;

an alignment means and locking means for aligning and securing the knife for honing;

a first honing means for honing the convex surface of the knife blade;

a second honing means for honing the concave surface of the knife blade;

means for causing the knife blade to contact the first honing means;

means for causing the knife blade to contact the second honing means;

the first and second honing means honing the convex and concave surfaces of the knife blade respectively without removing the knife blade from the locking means;

wherein, the spindle rotates passing the convex surface of the blade over the first honing means, continues rotating the knife to a position in front of the second honing means which then hones the concave surface of the blade, and then rotates back to its initial position with the movement being repeated until the blade is honed.

6. The apparatus of claim 5 wherein the mounting means contains a sized slot which accepts the body of a cob cutter knife.

7. The apparatus of claim 5 wherein the alignment means further comprises a vertical shaft which is received in a hole in the knife body and applies sufficient horizontal pressure to the knife that the blade positions itself adjacent to a locator surface having a radius surface which approximates that of the concave radius of the knife blade, and a pressure applicator which applies horizontal pressure to the convex surface of the vertical blade forcing it against the locator surface.

8. The apparatus of claim 7 wherein the vertical shaft applies between 2 and 4 pounds of pressure against the horizontal knife body.

9. The apparatus of claim 7 wherein the pressure applicator exerts approximately 60 pounds of pressure against the vertical blade.

10. The apparatus of claim 5 wherein the locking means further comprises a clamping spring which when activated is pulled in a downward direction, via an eccentric, which applies a downward pressure against the mounting bracket, locking the blade into position.

11. The apparatus of claim 5 wherein the first honing means further comprises a continuous belt grinder in which the belt is substantially vertically disposed.

12. The apparatus of claim 5 wherein the second honing means comprises a honing stone vertically mounted to an oscillating means, the honing stone having a free edge with a radius which approximates that of the concave surface of the vertical blade.

13. The apparatus of claim 12 wherein the oscillating means alternately pulls the honing stone in a backwardly and downwardly direction as the spindle rotates away from the honing stone and in an inwardly and upwardly direction when the spindle rotates the knife into position in front of the second honing means.

14. The apparatus of claim 11 wherein the first honing means hones the convex surface of the knife blade to a substantially 9° off vertical angle.

15. The apparatus of claim 12 wherein the second honing means creates a beveled edge of between 6° and 10° on the concave surface at the cutting tip of the knife blade.

16. The apparatus of claim 7 wherein the locator surface has a radius surface of no less than 0.79 inches and no greater than 0.83 inches.

17. The apparatus of claim 5 further comprising means for adjusting the pressure of the first honing means and second honing means against the knife blade and for adjusting the number of honing cycles to be applied to a given knife blade.

18. The apparatus of claim 2 wherein the second honing means creates a beveled edge of between 6° and 10° on the concave surface of the cob cutter blade.

19. The apparatus of claim 2 wherein a large cam rotates the spindle to a honing position of approximately 20°.

20. The apparatus of claim 2 wherein the first honing means engages the convex surface of the cutter blade as the spindle rotates from 20° through 340° and the second honing means engages the concave surface of the cob cutter blade as the spindle rotates from 330° through 280°.

21. The apparatus of claim 2 wherein the mounting means contains a sized slot which accepts a flat body portion of the cob cutter blade.

22. The apparatus of claim 2 wherein the alignment means further comprises a vertical shaft is received in a hole in the cutter blade and applies sufficient pressure to the blade that it positions itself adjacent to a locator surface having a radius surface which approximates that of the concave radius of the cob cutter blade, a stop to prevent the blade from moving beyond the locator surface, and a pressure applicator which applies pressure to the convex surface of the cob cutter blade forcing it against the locator surface to properly align it.

23. The apparatus of claim 22 wherein the vertical shaft applies between 2 and 4 pounds of pressure against the cob cutter blade.

24. The apparatus of claim 22 wherein the pressure applicator exerts approximately 60 pounds of pressure against the cob cutter blade.

25. The apparatus of claim 2 wherein the locking means further comprises a clamping spring which when activated is pulled in a downward direction via an eccentric, which applies a downward pressure to the mounting means thereby locking the blade into honing position, said spring being locked into place by the eccentric.

26. The apparatus of claim 2 wherein the first honing means further comprises a continuous belt grinder in which the belt is substantially vertically disposed.

27. The apparatus of claim 2 wherein the second honing means comprises a vertically mounted honing stone, the honing stone having a free edge with a radius which approximates that of the concave surface of the blade.

28. The apparatus of claim 27 wherein the honing stone moves in a backwardly and downwardly direction as the spindle rotates away from the honing stone and in an inwardly and upwardly direction as the spindle rotates the blade into position in front of the second honing means.

29. The apparatus of claim 22 wherein the locator surface has a radius of 0.79 inches.

30. The apparatus of claim 20 further comprising means for adjusting the angle and speed of the first honing means and second honing means and a means for adjusting the number of cycles applied to a given blade.

* * * * *